US008944977B2

(12) United States Patent
Foster et al.

(10) Patent No.: US 8,944,977 B2
(45) Date of Patent: Feb. 3, 2015

(54) COMBINATION ERGONOMIC TASK CHAIR AND EXERCISE DEVICE

(76) Inventors: Daniel N. Foster, Kingsport, TN (US); Michael Chris McGlaughlin, Waynesville, OH (US)

( * ) Notice: Subject to any disclaimer, the term of this patent is extended or adjusted under 35 U.S.C. 154(b) by 264 days.

(21) Appl. No.: 13/350,883

(22) Filed: Jan. 16, 2012

(65) Prior Publication Data

US 2012/0184410 A1 Jul. 19, 2012

Related U.S. Application Data

(60) Provisional application No. 61/433,311, filed on Jan. 17, 2011.

(51) Int. Cl.
*A63B 21/00* (2006.01)
*A63B 21/04* (2006.01)
(Continued)

(52) U.S. Cl.
CPC ..... *A47C 9/002* (2013.01); *A63B 21/023* (2013.01); *A63B 21/1419* (2013.01); *A63B 21/1453* (2013.01); *A63B 21/1476* (2013.01); *A63B 23/0233* (2013.01); *A63B 21/1492* (2013.01); *A63B 2021/1609* (2013.01);
(Continued)

(58) Field of Classification Search
CPC .... A63B 21/14; A63B 21/1492; A63B 21/02; A63B 21/045; A63B 21/023; A63B 21/026; A63B 23/0233; A63B 23/0211
USPC ..... 482/2, 8, 1, 121, 129, 130, 127, 133, 482/134, 135, 136, 137, 142, 904
See application file for complete search history.

(56) References Cited

U.S. PATENT DOCUMENTS 3,752,475 A * 8/1973 Ott ..... 482/127
5,110,121 A 5/1992 Foster
(Continued)

OTHER PUBLICATIONS

Corbin, Charles B., Gregory J. Welk, Willam R. Corbin, and Karen A. Welk. "Concept 11-09: Healthy Back Test." Concepts of Physical Fitness: Active Lifestyles for Wellness, 15/e. 15th ed. N.p.: McGraw-Hill Higher Education, n. d. N. pag. On the Web. Web. Dec. 15, 2013. <highered.mcgraw-hill.com/sites/0073376396/student_view0/concept11/on_the_web.html>.*
(Continued)

*Primary Examiner* — Loan H Thanh
*Assistant Examiner* — Sundhara Ganesan
(74) *Attorney, Agent, or Firm* — Knox Patents; Thomas A. Kulaga

(57) ABSTRACT

Apparatus for both supporting an occupant as a task chair and exercising the lumbar extensors. The chair has two configurations. One configuration is as a task chair. A second configuration is as an exercise device in which the arm rests move to restrain the anterior pelvic region and the lumbar support becomes a posterior pelvic restraint. The seatback moves through a range of motion with a strength curve ratio of about 1.4:1 between flexion and extension. The chair has a resistance mechanism that includes a four-bar linkage connected to a selectable group of coil springs. The chair includes a range of motion monitor and detectors that communicate with a feedback system, which indicates if the occupant is performing the exercise correctly. The feedback system displays a screen showing the angular position of the seatback with a comparison of the ideal position for the exercise.

20 Claims, 6 Drawing Sheets

(51) Int. Cl.

| | |
|---|---|
| ***A63B 21/045*** | (2006.01) |
| ***A63B 26/00*** | (2006.01) |
| ***A47C 9/00*** | (2006.01) |
| ***A63B 21/02*** | (2006.01) |
| ***A63B 23/02*** | (2006.01) |
| *A63B 21/16* | (2006.01) |
| *A63B 24/00* | (2006.01) |
| *A63B 71/06* | (2006.01) |

(52) U.S. Cl.

CPC *A63B 2024/0068* (2013.01); *A63B 2024/0081* (2013.01); *A63B 2071/0625* (2013.01); *A63B 2071/0647* (2013.01); *A63B 2071/0694* (2013.01); *A63B 2208/0233* (2013.01); *A63B 2220/13* (2013.01); *A63B 2220/16* (2013.01); *A63B 2220/18* (2013.01); *A63B 2220/803* (2013.01); *A63B 2220/833* (2013.01); *A63B 2225/09* (2013.01); *A63B 2225/20* (2013.01); *A63B 2225/50* (2013.01); *Y10S 482/904* (2013.01)

USPC ..... 482/137; 482/142; 482/127; 482/130; 482/904

(56) References Cited

U.S. PATENT DOCUMENTS

| | | | | |
|---|---|---|---|---|
| 5,288,130 | A | 2/1994 | Foster | |
| 5,556,363 | A * | 9/1996 | Hutchins | 482/101 |
| 6,733,077 | B2 | 5/2004 | Asano | |
| 7,004,543 | B2 | 2/2006 | Caruso et al. | |
| 7,393,054 | B2 | 7/2008 | McQueen et al. | |
| 7,537,553 | B2 * | 5/2009 | Mongelluzzo et al. | 482/130 |
| 2002/0142898 | A1 * | 10/2002 | Willis et al. | 482/130 |
| 2006/0116259 | A1 | 6/2006 | Smith | |
| 2007/0254787 | A1 * | 11/2007 | Matsubara et al. | 482/139 |
| 2008/0004166 | A1 * | 1/2008 | Oren et al. | 482/142 |
| 2008/0076643 | A1 * | 3/2008 | Sencil | 482/97 |
| 2008/0214357 | A1 * | 9/2008 | Farinelli et al. | 482/8 |
| 2011/0291449 | A1 * | 12/2011 | Serlachius | 297/230.11 |

OTHER PUBLICATIONS

Office Action, Paper No. 20071015, Mail Date Oct. 18, 2007, for U.S. Appl. No. 11/402,787, filed Apr. 12, 2006.

Response to Office Action filed Feb. 19, 2008 for U.S. Appl. No. 11/402,787, filed Apr. 12, 2006.

Office Action, Paper No. 20080614, Mail Date Jun. 17, 2008, for U.S. Appl. No. 11/402,787, filed Apr. 12, 2006.

Response to Office Action filed Sep. 18, 2008 for U.S. Appl. No. 11/402,787, filed Apr. 12, 2006.

Office Action, Paper No. 20081118, Mail Date Nov. 20, 2008, for U.S. Appl. No. 11/402,787, filed Apr. 12, 2006.

Response to Office Action filed Mar. 23, 2009 for U.S. Appl. No. 11/402,787, filed Apr. 12, 2006.

Office Action, Paper No. 20090719, Mail Date Jul. 21, 2009, for U.S. Appl. No. 11/402,787, filed Apr. 12, 2006.

Response to Office Action filed Aug. 27, 2009 for U.S. Appl. No. 11/402,787, filed Apr. 12, 2006.

Office Communication, Examiner's Amendment, Mail Date Sep. 8, 2009, for U.S. Appl. No. 11/402,787, filed Apr. 12, 2006.

Advisory Action, Paper No. 20090924, Mail Date Sep. 25, 2009, for U.S. Appl. No. 11/402,787, filed Apr. 12, 2006.

Office Communication, Interview Summary, Paper No. 20091001, Mail Date Oct. 6, 2009, for U.S. Appl. No. 11/402,787, filed Apr. 12, 2006.

Office Action, Paper No. 20091002, Mail Date Oct. 19, 2009, for U.S. Appl. No. 11/402,787, filed Apr. 12, 2006.

U.S. Appl. No. 11/402,787 filed Apr. 12, 2006, including Request for Non-Publication.

* cited by examiner

COMBINATION ERGONOMIC TASK CHAIR AND EXERCISE DEVICE

CROSS-REFERENCE TO RELATED APPLICATIONS

This application claims the benefit of U.S. Provisional Application No. 61/433,311, filed Jan. 17, 2011. Application Ser. No. 11/402,787, filed Apr. 12, 2006, and disclosing an invention by the same inventors herein, is hereby incorporated by reference.

STATEMENT REGARDING FEDERALLY SPONSORED RESEARCH OR DEVELOPMENT

Not Applicable

BACKGROUND

1. Field of Invention

This invention pertains to a chair that is a combination ergonomic task chair and an exercise device. More particularly, this invention pertains to a chair that supports a person as a task chair and also interacts with a computing device to exercise the lower back of the person.

2. Description of the Related Art

In our modern world, people are spending more time sitting in chairs than in years past. Society has progressed from a labor force that performed primarily manual labor to one that performs office-type work. Whereas people used to sit for short periods of time, now people often sit for extended periods of time. It is not uncommon for a person to spend a working day seated and, upon returning home, to remain seated for the remainder of the day.

The human body is not particularly suited to remain in a seated position for extended periods. Lower back pain and injury is one of the most common and costly work-related medical problems in the United States. People who work in a seated position run a high risk of low-back pain and injury.

For continued good health it is important that chairs are ergonomically configured. For many years the science of ergonomics has been applied to chair design in attempts to solve the problem of lower back pain and injury from prolonged sitting. Chairs have become more comfortable and more supportive during this time. Yet the incidence and cost of back injuries associated with prolonged sitting continues to increase. Clearly, ergonomically sound chairs are not sufficient. In existing ergonomic chairs, the back rest and lumbar support are physically connected to one another, either rigidly, or by fabric or mesh.

For continued good health it is important that sedentary persons, such as those that remain seated for extended periods, exercise periodically. Attempts have been made to combine ergonomic chairs with exercise. For example, U.S. Pat. No. 5,110,121, titled "Exercise chair for the lower back" discloses an office chair that incorporates features allowing the occupant to exercise while seated. Another example is U.S. Pat. No. 5,288,130, titled "Chair for the lower back," that discloses an office chair adapted to allow the occupant to exercise. Although an improvement over standard office chairs, these attempts to provide for exercise with an office chair do not go far enough. Additionally, these chairs do not provide the proper resistance curve for the lumbar extensor muscles (linear and ascending instead of linear and descending). The improper resistance curve of these chairs encourages the user to move too fast, thereby creating dangerous momentum in an attempt to overcome the increasing resistance, resulting in increased risk of injury. These chairs also lack a feedback system to aid the user to insure the safe and effective performance of the exercise.

Exercise has the potential to reverse many of the degenerative spinal changes caused by prolonged seating. Such changes include muscular atrophy, increased fatty infiltration of muscle, decreased bone mineral density, and increased soft-tissue stiffness. Lumbar strengthening also provides the seated worker with a reduction of risk of low back pain and injury while away from work. Employers are often concerned about potentially harmful lifestyle activities that may increase the risk of injury. Lumbar strengthening has been proven effective for the prevention of low back pain and injury (with healthcare cost savings and increased productivity) in workplace settings with manual labor workers. Similar results are expected with seated workers Various options are available for exercise programs that seated workers can perform at their work-stations. These programs consist of calisthenic type exercises to stretch and improve blood flow in the muscles stressed by prolonged seating. These exercises are indeed beneficial for this purpose. However, these exercises do not stimulate gains in muscle strength or increases in lumbar muscle morphology. Also, adherence to these exercise programs is often poor.

Much like a brace for a weak knee, an ergonomic chair provides external support for the spine. Greater stability and protection can only be achieved by strengthening the muscle groups that support the spine. The ergonomic chair enables the user to augment the internal support of their lumbar spine. The combination of external and internal support provides maximum protection against the stresses of prolonged seating.

BRIEF SUMMARY

According to one embodiment of the present invention, a chair that is both an ergonomic task chair and an exercise device is provided. The chair has a seat and a seatback and is supported by a wheel assembly. The chair has a lumbar support that is a posterior pelvic restraint when the chair is used as an exercise device. The seatback and lumbar support are adjustable and move independently, allowing separate adjustments for the recline of the seatback, or back rest, and the height and depth of the lumbar support during sitting. If desired, the lumbar support can also be adjusted downward to provide direct support to the posterior pelvis. The chair has arm rests that are anterior pelvic restraints when the chair is used as an exercise device.

When used as an exercise device, the armrest pads rotate to become anterior pelvic restraints and the seatback pivots through a selected angular arc. The force applied through the seatback is determined by a resistance mechanism that includes a four-bar linkage mechanism and a coil assembly. The four-bar linkage mechanism is configured to provide approximately a 1.4 to 1 linear and descending resistance curve through 72 degrees of range of motion of the lumbar extensors of the occupant of the exercise device.

The chair includes detectors that monitor the number and size of the springs engaged. The chair also includes a position sensor that determines the angular position of the seatback. The detectors and sensors are connected to a controller that provides a signal to a transmitter. A remote feedback system monitors the signal from the transmitter. The received signal is processed and provided to a computer with a display. The computer executes software that accesses the various variables, determines the status of the chair during the exercise, and displays information on a screen for use by the occupant.

The chair enables exercise to strengthen and stimulate lasting improvements in lumbar muscle morphology—the specific outcomes necessary to prevent low back pain and injury in seated workers. Additionally, the chair provides benefits of computer feedback to increase adherence and the likelihood of successful outcomes

BRIEF DESCRIPTION OF THE SEVERAL VIEWS OF THE DRAWINGS

The above-mentioned features will become more clearly understood from the following detailed description read together with the drawings in which.

DETAILED DESCRIPTION

Apparatus for a combination chair 100 that provides seating as a task chair 100-TC and as an exercise device 100-ED to exercise the lumbar extensor muscles is disclosed. The chair 100, in combination with a remote feedback system 800, aids an occupant 102 with exercising the lumbar extensor, or erector spinae, muscles.

Figure 1:
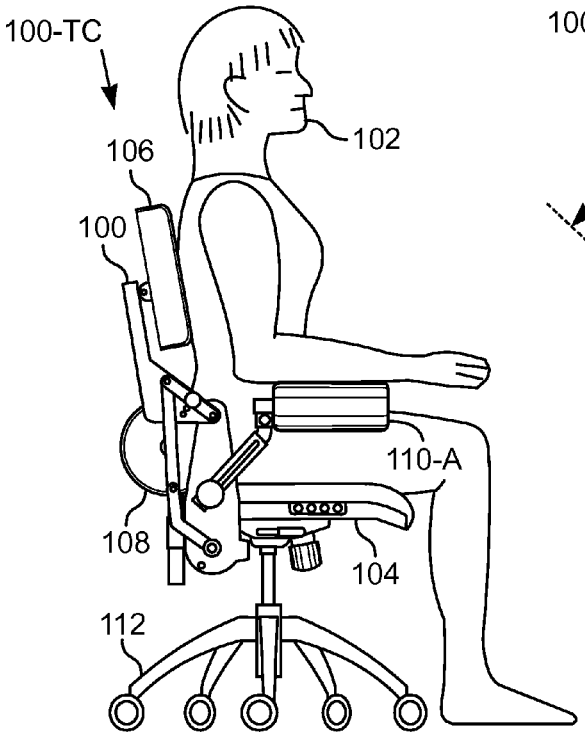
FIG. 1 is a side view of one embodiment of a combination chair being used as a task chair with a person seated in the chair.

FIG. 1 illustrates a symbolic side view of one embodiment of a combination chair 100 being used as a task chair 100-TC with a person 102 seated in the chair 100. The chair 100 includes a seat 104 and a backrest, or seatback, 106. Above the seat 104 is a pair of arm rests 110-A configured for supporting the arms of the occupant 102. Below the backrest 106 is a lumbar support 108. The support for the chair 100 includes the wheel assembly 112.

The person 102 sits upright in the chair 100 when the chair 100 is in the configuration of a task chair 100-TC. For example, when working at a desk, the person 102 sits in the task chair 100-TC, which provides ergonomic support for the person 102. The chair 100 includes, in various embodiments, various adjustments to support the occupant 102 at an ergonomically desired position relative to the floor and workstation.

Figure 2:
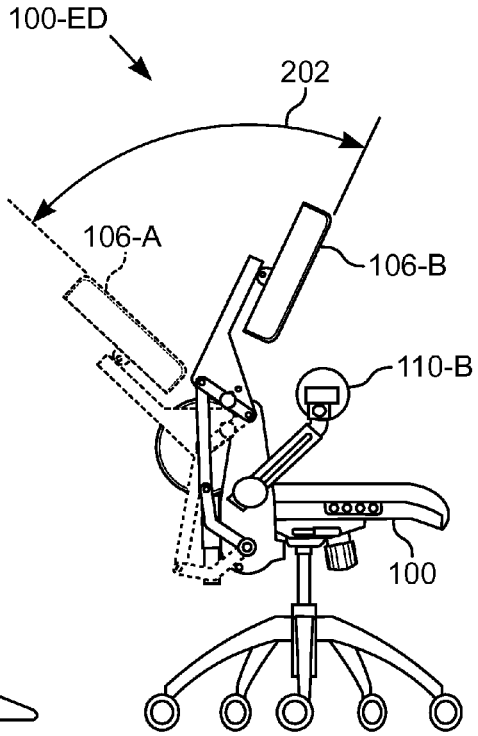
FIG. 2 is a side view of one embodiment of a combination chair configured as an exercise device showing the seatback positions for extension and forward flexion.

FIG. 2 illustrates a side view of one embodiment of a combination chair 100 configured as an exercise device 100-ED showing the seatback positions 106-A, 106-B for extension and forward flexion, respectively. Configured as an exercise device, the chair 100-ED has its arm rests 110-B rotated approximately 60 degrees in a horizontal plane such that the padded portions 428 become anterior pelvic restraints with the padded portion 428 positioned against the anterior superior iliac spine (ASIS) of the occupant 102. The illustrated arm rests 110-B are padded members that, depending upon the size and shape of the occupant 102, will contact a region of the body between the upper legs and the abdomen. In order to restrain the pelvis from rotating, the arm rests 110-B direct pressure against the ASIS. The lumbar support 108 moves downward from a lumbar support position to a posterior pelvic restraint position with the lumbar support 108 positioned against the posterior superior iliac spine (PSIS) of the occupant 102. The anterior and posterior pelvic restraints 110, 108 prevent the occupant's pelvis from rotating backwards or forwards during exercise. In this way, the exercise device 100-ED secures the anterior superior iliac spine with the anterior pelvic restraints, or rotated arm rests, 110-B and secures the posterior superior iliac spine by the posterior pelvic restraint, or lumbar support, 108.

The chair 100 includes a release, or knob 408 that allows the chair 100 to switch between the task chair configuration 100-TC and the exercise device configuration 100-ED. The seatback 106 is secured to the four-bar linkage mechanism 430 with the knob 408 in multiple positions. As illustrated in FIG. 1, the seatback 106 is positioned for the chair 100 to be used as a task seat 100-TC. As illustrated in FIG. 2, the seatback 106-B is positioned on the four-bar linkage mechanism 430 such that the seatback 106-B rests in the forward position. The seatback 106 pivots between a rear position 106A and a forward position 106-B. The seatback 106 defines an arc 202, which is the angular range of motion of lumbar flexion. The seatback 106 is biased forward toward the forward position 106-B. The occupant 102 exercises by repeatedly forcing the seatback 106 to the rear position 106-A and slowly resisting the bias as the seatback 106 moves to the forward position 106-B.

Figure 3:
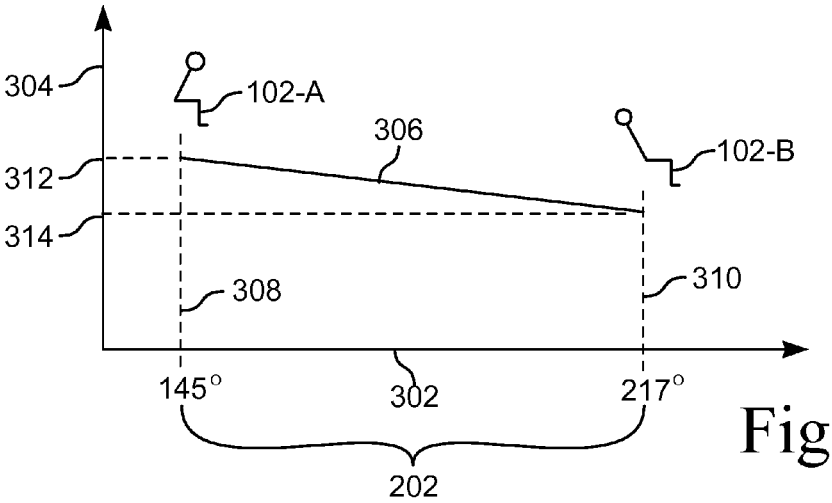
FIG. 3 is a graph depicting the torque versus range of motion between extension and forward flexion of the lumbar extensor muscles.

FIG. 3 illustrates a graph depicting the torque 304 versus range of motion 302 curve 306 between forward flexion 102-A and extension 102-B of the lumbar extensor muscles. The axis 302 representing range of motion shows the degrees of the arc 202, which in the illustrated embodiment ranges from 145 degrees to 217 degrees, with 180 degrees representing the occupant 102 sitting in the upright position. The 217 degree position 310 corresponds to 0 degrees of lumbar flexion of the occupant 102-B. The 145 degree position 308 corresponds to 72 degrees of lumbar flexion of the occupant 102-A. The torque curve 306 shows that the torque applied by the seatback 106 decreases by 40% as the range of motion 302 goes from 72 degrees of lumbar flexion 310 to 0 degrees of lumbar flexion 308.

The 40% decrease or 1.4:1 ratio of linear decreasing variable resistance curve 306 matches the specific strength curve of the lumbar extensor, or erector spinae, muscles. According to sound principles of resistance training, the resistance curve 306 of the chair 100 in the exercise configuration matches the strength curve of the targeted muscle group. This type of resistance is known as variable resistance. The strength curve 306 is linear-descending from flexion to extension, through a total range of motion (ROM) of 72 degrees 202. The lumbar extensors are typically 1.4 times stronger in flexion than in extension, hence the strength curve 306 is expressed as a ratio of 1.4:1.

Figure 4:
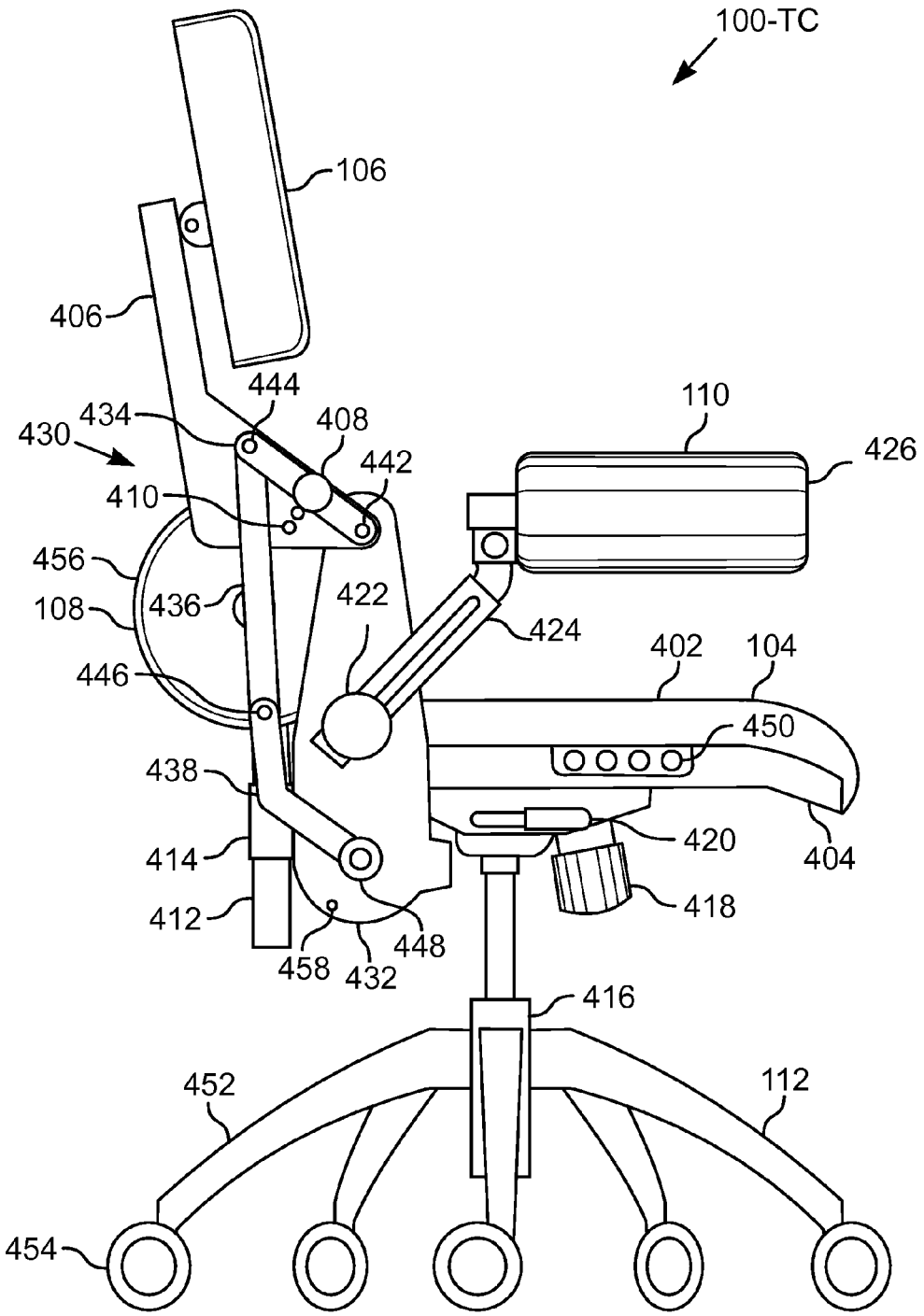
FIG. 4 is a side view of one embodiment of the combination chair in its task chair configuration.

FIG. 4 illustrates a side view of one embodiment of the combination chair 100 in its task chair configuration 100-TC.

The task chair 100-TC configuration is suitable for supporting a person 102 who is performing tasks desired to be performed while seated.

The chair 100 includes a wheeled support assembly 112, a seat 104, a seatback 106, and arm rests 110. The wheeled support assembly 112 includes a spider base 452 that has wheels 454. The spider base 452 has a pedestal 416 that, in one embodiment, is an adjustable gas, or pneumatic, cylinder. In the illustrated embodiment, the spider base 452 has a high attachment to the pneumatic cylinder 416, which has a shortened length extending above the attachment. The high spider base 452 and shortened cylinder 416 provides a stable platform that withstands the stresses caused by the chair 100 when it is in the exercise device configuration 100-ED. To further aid the stability of the chair 100 as an exercise device 100-ED, the pedestal 416 attaches to the seat 104 at a position further back than it would be on a typical task chair. The position of the pedestal 416 relative to the seat pan 404 is such that the exercise device 100-ED and occupant's 102-B center of gravity remains over the spider base 452 when the exercise device 100-ED is used with the seatback 100-A in the full extension position. In one such embodiment, the exercise device 100-ED and occupant's 102-B center of gravity is substantially centered over the pedestal 416 during the exercise.

The seat 104 includes a seat pan 404 and a cushion 402. The seat pan 404 is attached to the pedestal 416 and includes the various chair controls 418, 420. For example, one such chair control is the seat tilt tension control 418. Another such chair control is the release lever 420 that adjusts the seat height via the gas cylinder and locks or releases the seat tilt mechanism. A group of force selection knobs 450 is located on each side of the seat pan 404.

Attached to the rear of the seat pan 404 is the lumbar support 108. In one embodiment, the lumbar support 108 has a T-shaped configuration with a vertical member 412 extending downward from a pair of rollers 456. The vertical member 412 is a tube that engages a hollow tube, or bracket, 414 that is attached to the seat pan 404. In various embodiments, the vertical member 412 is straight or bent to meet the requirements of the chair 100. In one embodiment, the vertical member 412 has a series of holes and the bracket 414 has a pin, such as a spring-loaded pop-pin body, that selectively engages one of the series of holes to lock the lumbar support 108 at a desired vertical position. In another embodiment, a geared assembly is used to adjust the vertical height of the lumbar rollers 456. In yet another embodiment, the vertical height of the lumbar rollers 456 is adjusted by a ratchet mechanism. The rollers 456, in one embodiment, are eight inches in diameter and consist of two layers of polyurethane foam covered with upholstery. The inner layer of foam is more rigid than the outer layer of foam, which is more deformable. In another embodiment of the lumbar support 108, the support 108 includes a roller 456 and a pair of vertical members 412 on the sides of the roller 456.

Also attached to the rear of the seat pan 404 is a pair of supports 432. The seat 104 is between the supports 432. The support 432 forms one bar of the four-bar linkage mechanism 430 that includes an upper bar 434, an outer bar 436, and a lower bar 438. The support 432 is fixed in position relative to the seat pan 404. The upper bar 434 is attached to the support 432 by a first pivot 442. The upper bar 434 is attached to the outer bar 436 by a second pivot 444. The outer bar 436 is attached to the lower bar 438 by a third pivot 446. The lower bar 438 is attached to the lower end of the support 432 by fourth pivot, or drive shaft, 448. The lower bar 438 has a bent configuration to allow the bar 438 to pivot without hitting where the arm rest 110 attaches to the support 432. Below the lower bar 438 is a stop 458 that limits the downward swing of the lower bar 438. The stop 458 is positioned such that the backrest 106 and the upper and lower bars 434, 438 cannot move beyond a maximum lumbar extension 102-B. The stop 458 limits the angular range of motion of lumbar flexion between the normal position of the upper and lower bars 434, 438 at lumbar flexion 102-B and the position of the upper and lower bars 434, 438 at lumbar extension 102-B.

Attached to the support 432 at the first pivot 442 is the movement arm 406. In the illustrated embodiment, movement arm 406 has two side members that are each positioned proximate each support 432. The side members of the movement arm 406 are connected with a top member, which supports the pad of the seatback 106. The movement arm 406 moves in tandem with the upper bar 434 as it rotates around the first pivot 442. The illustrated embodiment of the side members of the movement arm 406 include a series of holes 410 that are selectively placed in register with a pin attached to a seatback adjustment knob 408. In one such embodiment, the pin is a spring-loaded pop-pin. The holes 410 in the movement arm 406 are positioned such that the maximum lumbar flexion 308 is adjustable to 72 degrees and selected values less than 72 degrees, such as 60, 48, and 36 degrees by engaging one of the holes 410 in the movement arm 406 by the pin attached to the knob 408. The movement arm 406 and seatback 106 rotates in an angular arc 202 corresponding to the selected hole 410. The illustrated embodiment shows the chair 100 configured as a task seat 100-TC. To configure the chair 100 as an exercise device 100-ED, the knob 408 is actuated to disengage the hole 410 so that the seatback 106 rotates forward to the desired starting position 106-B. With the seatback 106-B in the desired position, the knob 408 engages the corresponding hole 410 and the seatback 106 is secured to the upper bar 434 and moves with the bar 434. In one embodiment, the movement arm 406 is biased to pivot to the forward position 106-B when the knob 408 disengages the hole 410. In this way the seat occupant 102 can adjust the seatback 106 to the desired angle by actuating the knob 408 and leaning forward the desired amount and the engaging the knob 408. The seatback 106 is biased forward and moves forward as the occupant 102 leans forward.

Also attached to the support 432 on each side of the chair 100 is an arm rest 110 that includes a clamping knob 422, telescoping support 424, and the armrest pad 426. The clamping knob 422 secures the telescoping support 424 to the support 432. The telescoping support 424 adjusts to position the armrest pad 426 at the desired height and orientation. The task chair configuration 100-TC has the armrest pads 426 oriented parallel to the front to rear axis of the chair 100 to form arm rests 100-A. The exercise device configuration 100-ED has the armrest pads 426 oriented perpendicular to the front to rear axis of the chair 100 to form anterior pelvic restraints 100-B. The support structure for the armrest pads 426 rotate or pivot approximately 60 degrees in a substantially horizontal plane where the support structure for the pads 426 connect to the telescoping supports 424.

Figure 5A:
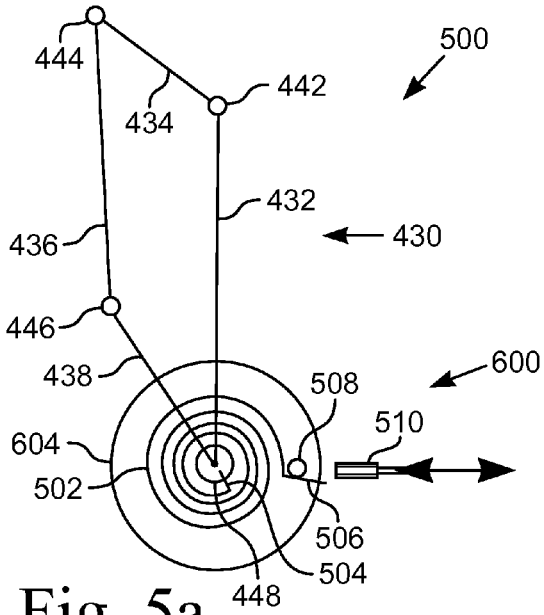
FIG. 5*a* is a symbolic side view of one embodiment of the resistance mechanism at its rest position with the spring disengaged.
Figure 5B:
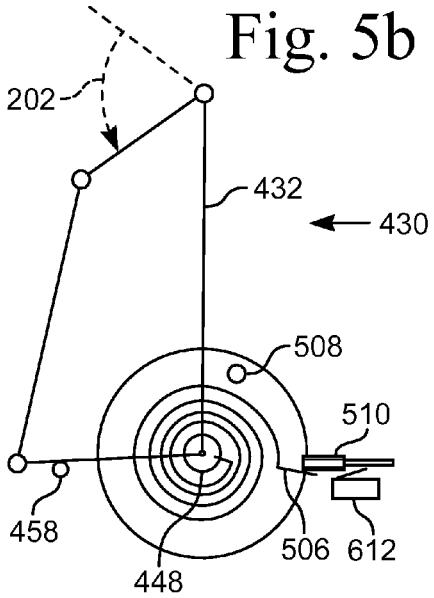
FIG. 5*b* is a symbolic side view of one embodiment of the resistance mechanism at its extended position with the spring engaged.
Figure 6:
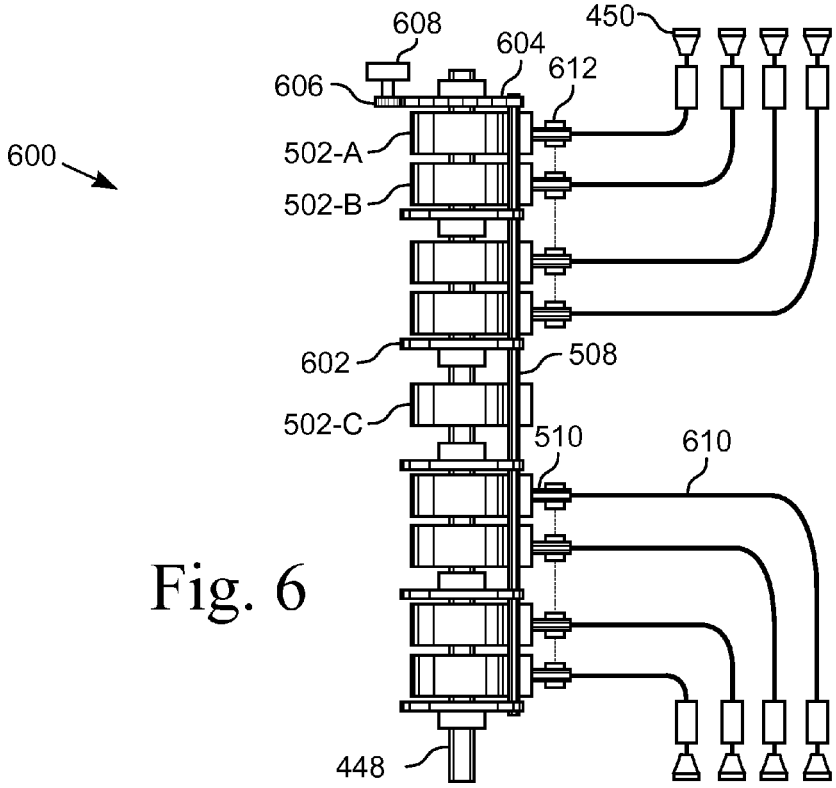
FIG. 6 is a top view of one embodiment of a coil assembly of the resistance mechanism.

FIG. 5*a* illustrates a symbolic side view of one embodiment of the resistance mechanism 500 at its rest position with the spring 502 disengaged. With the configuration illustrated in FIG. 5*a*, the spring 502 rotates with the drive shaft 448 and provides no resistance. FIG. 5*b* illustrates a symbolic side view of one embodiment of the resistance mechanism 500 at its extended position with the spring 502 engaged. With the configuration illustrated in FIG. 5*b*, one end 506 of the spring 502 is fixed and the spring provides resistance for exercising. FIG. 6 illustrates a top view of one embodiment of a coil assembly 600 of the resistance mechanism 500. The resistance mechanism 500 includes a four-bar linkage mechanism 430 and a coil assembly 600 that includes a plurality of coil springs 502. The four-bar linkage mechanism 430 transfers the resistance from the coil assembly 600 to the movement arm 406 and the seatback 106. The four-bar linkage mechanism 430 converts the linear and ascending resistance curve provided by the coil assembly 600 to a linear and descending resistance curve 306 corresponding to the strength curve of the lumbar extensor muscles.

The four-bar linkage mechanism 430 includes the support 432, the upper bar 434, the outer bar 436, and the lower bar 438, and their associated pivots 442, 444, 446, 448. The support 432 is stationary. The lower bar 438 is connected to the drive shaft 448 and the lower bar 438 rotates in tandem with the drive shaft 448. A stop 458 is positioned to engage the lower bar 438, which defines the end of the range of motion 202 of the upper bar 434. The drive shaft 448 is supported by bearings attached to the seat pan 404. In one embodiment, the resistance mechanism 500, which includes the four-bar linkage mechanism 430 in combination with the resistance provided by the coil assembly 600, provides the desired torque curve 306 with a 1.4 to 1 ratio between 0 degrees and 72 degrees of lumbar flexion 202. In another embodiment, the resistance mechanism 500 provides the desired torque curve 306 with at least a 1.4 to 1 ratio between 0 degrees and 72 degrees of lumbar flexion 202. In such an embodiment, the occupant 102 is required to exert greater effort when starting at the lumbar flexion position 102-A. In other embodiments, the resistance mechanism 500 provides the desired torque curve 306 with a ratio of between 1.3 to 1 and 1.5 to 1 between 0 degrees and 72 degrees of lumbar flexion 202. In such an embodiment, the occupant 102 is required to exert greater effort to finish at the lumbar extension position 102-B.

Research demonstrates that the strength curve 306 for the lumbar extensor muscles is linear and descending. Beginning from a position of trunk flexion 102-A, lumbar strength gradually declines as the person moves backwards into lumbar extension 102-B. The proper variable resistance curve 306 for the lumbar extensor muscles must also be linear and descending as seen in FIG. 3. The shape of the lumbar extension strength curve 306 is typically expressed as a ratio of 1.4:1 (flexion to extension strength). In other words, a person is 1.4 times as strong in the fully flexed position 102-A as he is in the fully extended position 102-B. Without variable resistance, a person is limited by the weakest joint angle (position) within a movement. The maximum amount of resistance that a person can successfully complete a full repetition is equal to the amount of resistance that the person can overcome (lift) at his weakest joint angle. For example, if a person's maximum strength in lumbar flexion 102-A is 140 ft.-lbs of torque, and his strength in full extension 102-B is 100 ft.-lbs, the maximum amount of resistance that he can complete a full repetition with would be 100 ft.-lbs. If he tried to lift 140 ft.-lbs, the gradually decreasing strength curve would prevent him from moving backward beyond a few degrees of motion. Variable resistance machines provide a level of resistance that matches strength as it varies throughout the full range of motion 202. In this case, 140 ft.-lbs. in lumbar flexion, gradually decreasing to 100 ft.-lbs in lumbar extension.

Spiral torsion springs 502 provide a linear and ascending resistance—the more you wind the spring, the greater the resistance. The spring's resistance curve is the opposite of the lumbar extension strength curve 306. The four-bar linkage mechanism 430 is used in combination with the springs 502 to alter the leverage of the resistance mechanism 500 and provide the desired linear and descending resistance curve 306. In one embodiment, each of the selectable spiral torsion springs 502-A, 502-B are pre-loaded to provide a beginning level of resistance of 100 ft.-lbs and one spring 502-C is pre-loaded to 50 ft.-lbs. Each spring 502 provides a net resistance of 20 or 10 ft.-lbs, which, when multiplied by the length of the movement arm, results in the resistance felt by the occupant 102. Pre-loading keeps the size and weight of the spiral torsion springs 502 suitable for use on an ergonomic chair 100. Springs that provide the desired level of resistance without pre-loading are often too large and too heavy for such application.

In one embodiment, the support 432 measures 11.25 inches in length from the center of the drive shaft 448 to the center of the first pivot 442. The upper bar 434 measures 4.85 inches in length and is oriented at a 145 degree start angle relative to horizontal at the pivot 442 at the support 432. The outer bar 436 measures 9.05 inches in length and is oriented at a 5 degree angle relative to the support 432. The lower bar 438 measures 6.05 inches in length and is fixed at a 35 degree angle to the drive shaft 448.

In the illustrated embodiment, the coil springs 502 are spiral torsion springs. Each coil spring 502 has a first end 504 and a second end 506. The first end 504 is attached to the drive shaft 448. The second end 506 is either engaged with an engaging pin 510 or a rod 508. With the rod 508 engaging the second end 506, the spring 502 is preloaded with the four-bar linkage 430 in the position illustrated in FIG. 5*a*. The rod 508 is coupled to the drive shaft 448 by the disks 602 and gears 604 and rotates in tandem with the drive shaft 448. As illustrated in FIG. 5*a*, with the engaging pin 510 retracted such that the rod 508 engages the spring 502, the spring 502 does not exert any force to the drive shaft 448. To engage the engaging pin 510, the four-bar linkage 430 is placed in the resting position as illustrated in FIG. 5*a*. In this position the drive shaft 448 is positioned such that the rod 508 engages the second end 506 of the spring 502 above the engaging pin 510 and the second end 506 is positioned to receive the engaging pin 510 as it slides toward the drive shaft 448. The pin 510 is moved toward the drive shaft 448 by the corresponding force selection knob 450 being pushed in. The knob 450 moves the cable 610, which moves the engaging pin 510.

The illustrated embodiment of the coil assembly 600 includes eight selectable springs 502-A, 502-B and one fixed spring 502-C. The selectable springs 502-A, 502-B each have an associated engaging pin 510 such that any one or more selectable springs 502-A, 502-B is selectable to increase the force applied to the drive shaft 448.

In one embodiment, the selectable springs 502-A, 502-B provide different values of torque. For example, the first spring 502-A provides 10 lbs. of resistance when the engaging pin 510 engages the coil 502-A. The second spring 502-B provides 20 lbs. of resistance when the engaging pin 510 engages the coil 502-B. The fixed spring 502-C has the second end 506 anchored to the chair/seat pan 404 to preload the drive shaft 448 to ensure the drive shaft 448 returns to a consistent starting point.

In one embodiment, the coil springs 502 provide a spring constant of 1.6 lbs per degree of deflection. To provide a preload or resistance of 20 ft.-lbs to the seatback 106-B at the start of the range of motion 202, the springs 502-B are deflected 125 degrees. To provide a preload or resistance of 10 ft.-lbs at the start of the range of motion 202, the springs 502-A are deflected 62.5 degrees. The preload on the springs 502-A, 502-B is maintained by the rod 508, which is held in fixed relation to the drive shaft 448 by the disks 602 between the coils 502 and the gear 604 at one end of the drive shaft 448.

The gear 604 at the end of the drive shaft 448 engages a spur gear 606 attached to a sensor 608, such as a potentiometer. The sensor 608 provides an output corresponding to the angular position of the gear 604 and the drive shaft 448. Associated with each engaging pin 510 is a detector 612 that senses if the engaging pin 510 has moved to engage the second end 508 of its associated coil 502. In one embodiment, the detector 612 is a microswitch that is actuated by the engaging pin 510.

Figure 7:
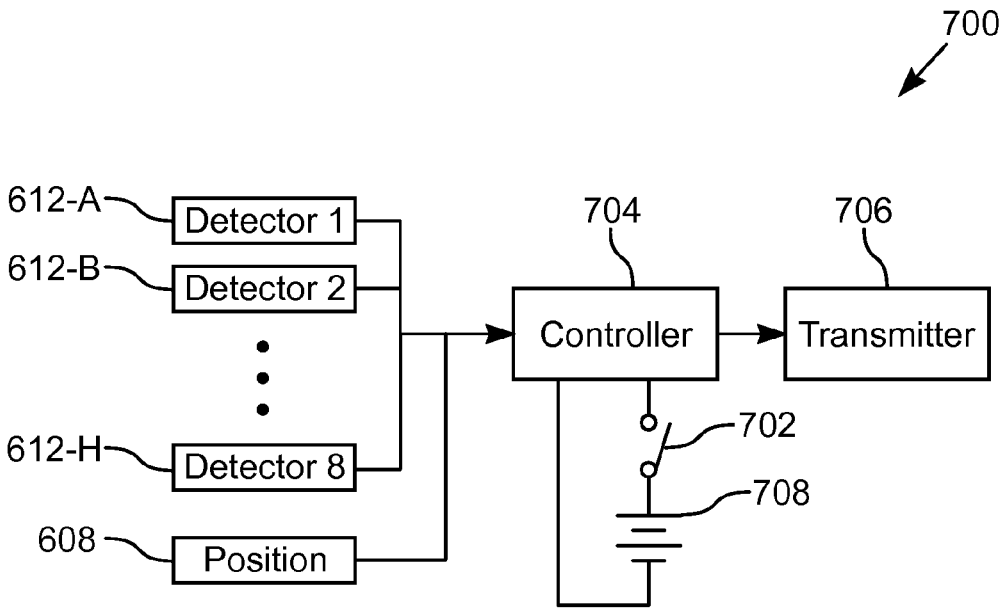
FIG. 7 is a functional block diagram of one embodiment of the chair monitor.

FIG. 7 illustrates a functional block diagram of one embodiment of the chair monitor 700. The chair monitor 700 senses variables associated with the chair 100 used as an exercise device 100-ED and transmits those variables to a remote feedback system 800. The chair monitor 700 includes the sensor 608 that indicates the position of the drive shaft 448 and, consequently, the angular position of the seatback 106. The chair monitor 700 also includes the detectors 612-A to 612-H that indicate which coils 502 are engaged for the exercise device 100-ED. The outputs of the sensor 608 and detectors 612-A to 612-H are connected to the controller 704, which provides an output to the transmitter 706.

The controller 704 of the chair monitor 700 monitors the position sensor 608 and the detectors 612 to generate an output signal corresponding to the position of the seatback 106 and the number and size of springs 502 providing resistance to the seatback 106. In one embodiment, the transmitter 706 is a wireless transmitter, such as an RF (radio frequency) or IR (infrared) transmitter. For example, a Bluetooth transmitter is often used for short range communications. A battery 708 provides power to the chair monitor 700. In one embodiment, the chair monitor 700 includes a power switch 702 that allows the battery 708 to be isolated from the chair monitor 700 to extend the life of the battery 708.

As used herein, the controller 704 should be broadly construed to mean any device that accepts inputs and provides outputs based on the inputs, for example an analog control device or a microcontroller or computer or component thereof that executes software. In various embodiments, the controller 704 is one of a specialized device or a computer for implementing the functions of the invention. The controller 704 includes input/output (I/O) connections for communicating with external devices and a processing unit that varies the output based on one or more input values. The input component of the controller 110 receives input from external devices, such as detectors 612 and position sensor 608. The output component sends output to external devices, such as the transmitter 706.

Figure 8:
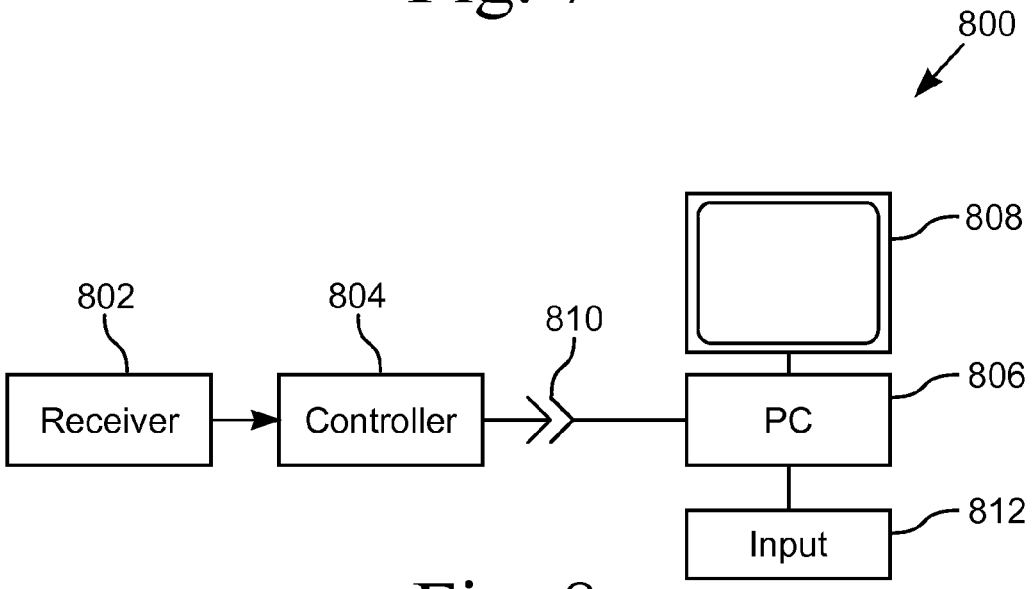
FIG. 8 is a functional block diagram of one embodiment of the remote feedback system.

FIG. 8 illustrates a functional block diagram of one embodiment of the remote feedback system 800. The remote feedback system 800 includes a receiver 802, a controller 804, a connection 810 to a computer 806 that has a display 808 and a user input 812, such as a keyboard and mouse.

The receiver 802 of the remote feedback system 800 is responsive to the transmitter 706 of the chair monitor 700. That is, if the transmitter 706 includes an IR LED transmitter, the receiver 802 includes a corresponding IR LED receiver. With an IR transmitter 706, the IR receiver 802 must be in line of sight of the transmitter 706 such that the receiver 802 is able to detect at least a portion of the transmitted signal.

The controller 804 of the remote feedback system 800 decodes the received signal and provides an output suitable for the computer 806. In one embodiment, the controller 804 communicates through a universal serial buss (USB) connection 810 with the computer 806. The USB connection 810 provides power to the controller 804 of the remote feedback system 800. In various such embodiments, the receiver 802 and controller 804 are housed in a package that plugs directly into a USB connection 810 on the computer 806 or are housed in a package that has a cable with a USB connector suitable for plugging into a USB connection 810 on the computer 806.

In one embodiment, the chair controller 704, transmitter 706, receiver 802, and remote controller 804 are functionally embodied in a device that provides signals corresponding to the outputs of the detectors 612 and the sensor 608 to the computer 806. In various such embodiments, the computer 806 is hardwired to the chair 100 and either located remotely or attached to the chair 100. In one embodiment, the feedback system 800 is a portable device, such as a tablet computer or other mobile computing device, that provides feedback to the occupant 102. In one such embodiment, the transmitter 706 and receiver 802 are Bluetooth or other wireless devices.

As used herein, the computer 808 should be broadly construed to mean any computer or component thereof that executes software. The computer 808 includes a memory medium that stores software, a processing unit that executes the software, and input/output (I/O) units for communicating with external devices. Those skilled in the art will recognize that the memory medium associated with the computer 808 can be either internal or external to the processing unit of the processor without departing from the scope and spirit of the present invention.

In one embodiment the computer 808 is a general purpose computer, in another embodiment, it is a specialized device for implementing the functions of the invention. Those skilled in the art will recognize that the computer 808 includes an input component, an output component, a storage component, and a processing component. The input component receives input from external devices, such as the connection 810 and other input devices 812. The output component sends output to external devices, such as the display 808. The storage component stores data and program code. In one embodiment, the storage component includes random access memory. In another embodiment, the storage component includes non-volatile memory, such as floppy disks, hard disks, and writeable optical disks. The processing component executes the instructions included in the software and routines.

Figure 9:
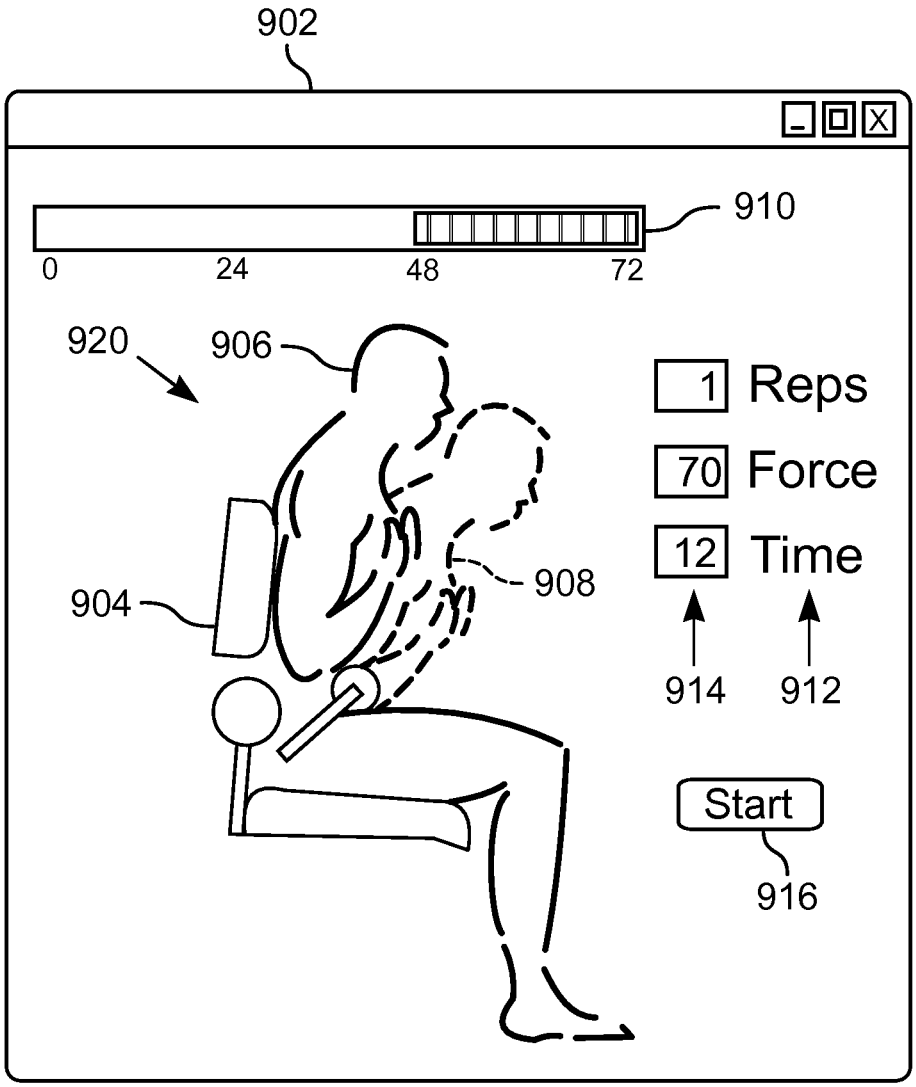
FIG. 9 is one embodiment of a representation of a computer screen providing feedback during exercising.

FIG. 9 illustrates one embodiment of a representation of a computer screen 902 providing feedback during exercising. When the exercise device 100-ED is employed to exercise the lumbar muscles, the remote feedback system 800 provides information and feedback to the occupant 102 of the exercise device 100-ED. FIG. 9 is one embodiment of a screen 902 output by the computer 806 on the display 808. The screen 902 displays sufficient information for the occupant 102 to exercise the lumbar muscles in a controlled and proper manner. The remote feedback system 800 and the screen 902 educates the occupant 102 on the benefits of exercise to strengthen the lumbar extensor muscles, provides instructions on how to perform the exercise properly, provides concurrent feedback during the exercise including visual and audible cues to maintain a slow, controlled speed of movement, and motivates the occupant 102 to perform the exercises on a regular basis.

The screen 902 displays both graphical and textual elements. One graphical element 920 is a representation 904 of the exercise device 100-ED with a FIG. 906 representing the occupant 102 of the exercise device 100-ED. The FIG. 906 overlays a shadow person 908, which represents the ideal position that the occupant 102 should be in at any particular time. That is, the graphical element 920 is a moving graphic that shows the actual position of the occupant 102 relative to where the occupant 102 should be while performing each repetition of the exercise. The shadow person 908 moves at a slow, controlled speed that is predetermined. The occupant 102 of the exercise device 100-ED is able to synchronize his movements with the position of the shadow person 908 on the screen 902. If the occupant 102 moves too fast relative to the shadow person 908, a visible alarm, such as a red stop graphic, is displayed on the screen 902, and an audible alarm, such as a high-pitched sound, is sounded by the computer 806. If the occupant 102 moves too slowly, appropriate visible and audible alarms are provided, as well. The visible and audible alarms cease when the occupant 102 resumes a proper pace as shown on the screen 902.

The screen 902 also displays the amount of lumbar flexion of the occupant 102 with a flexion bar 910. Also displayed on the screen 902 are information fields 914 proximate identifying indicia 912. The screen 902 displays such information as the number of repetitions performed, the force selected on the exercise device 100-ED, and the elapsed time. The screen 902 further displays control objects 916, for example a start button and/or other control buttons.

Figure 10:
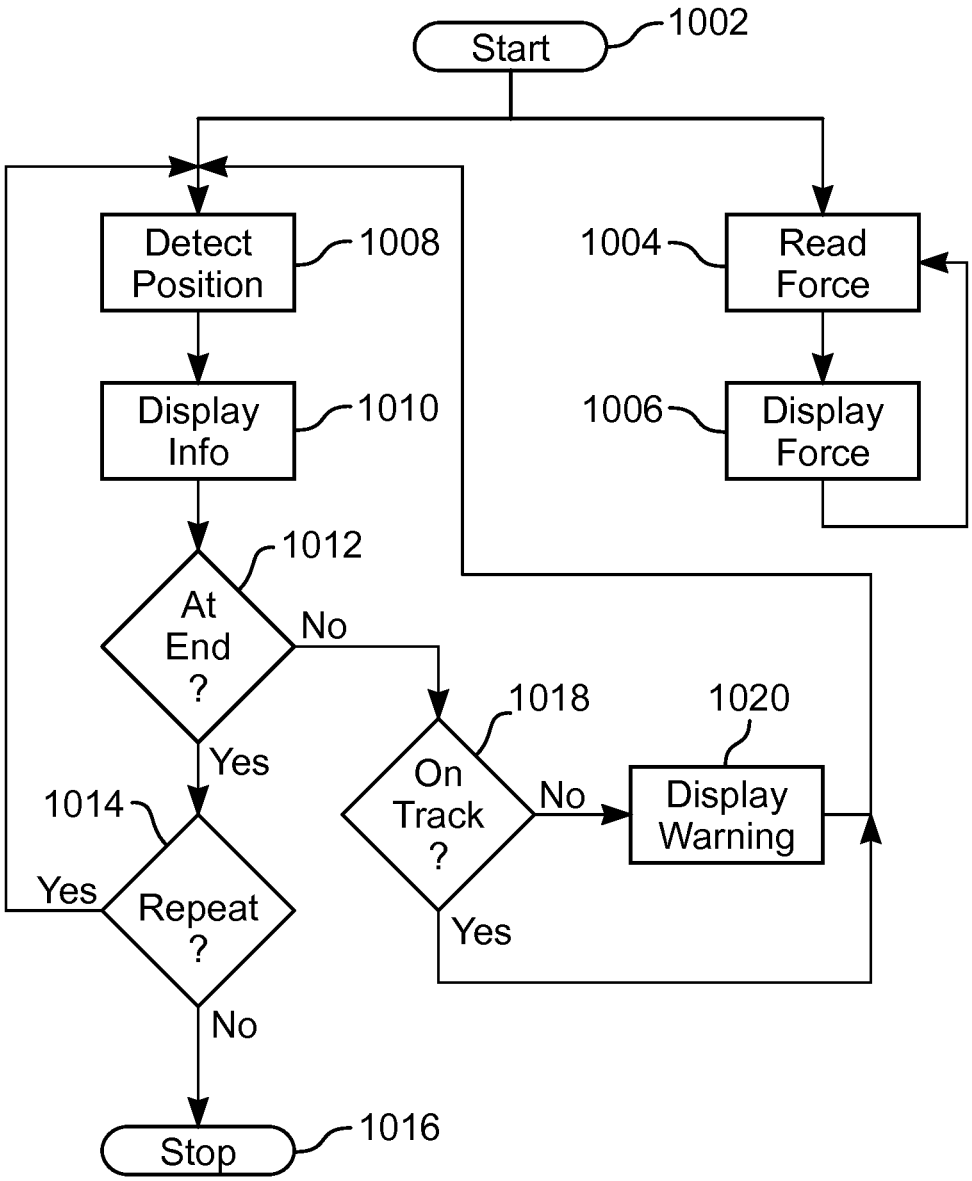
FIG. 10 is a flow diagram of one embodiment of the steps performed by the remote feedback system.

FIG. 10 illustrates a flow diagram of one embodiment of the steps performed by the remote feedback system 800. The first step 1002 is to start the routine. In one embodiment, the routine is started by actuating the start button 906 displayed on the screen 902. In another embodiment, the routine is started by the occupant 102 closing the power switch 702 in the chair monitor 700, which causes the chair variable to be transmitted to the remote feedback system 800, which is monitoring for a signal to be received by the receiver 802. In yet another embodiment, the software monitors the time and the routine is started at selected times or at selected intervals during the day or week.

Two different loops are performed in parallel. The first loop has a first step 1004 of reading the force variable, that is the setting on the chair 100 corresponding to the amount of force required or resistance applied to moving the seatback 106 through its range of motion. The next step 1006 is to display the force variable value on the screen 902. After the step 1006 of displaying, the routine loops back to the step 1004 of reading the variables. In this way the screen 902 is continually updated with the value of the force selected on the exercise device 100-ED.

The second loop has a first step 1008 of detecting or reading the position of the exercise device 100-ED. To perform this step 1008, the computer 806 accesses the angular position information that the receiver 802 receives from the sensor 608 in the chair monitor 700. The next step 1010 is to display the position information, such as with the graphical element 920 and the flexion bar 910. This step 1010 also displays the repetition number being performed. For example, the first time this step is performed, the screen 902 displays that the first repetition is being performed. With step 1010 the screen 902 is continually updated with the various values measured and calculated for the exercise routine on the exercise device 100-ED.

The next group of steps 1012, 1014, 1018, 1020 provide tracking of the exercise routine. The exercise routine is one or more sets of repetitions of back movements. Each repetition of a back movement includes moving the backrest 106 from the resting or forward position 106-B, to the rear position 106-A, and then back to the forward position 106-B. Typically, the repetitions are performed continuously one after the other with a short resting period between sets.

The next step 1012 is to determine if the occupant 102 is at either full lumbar flexion 102-A or at full lumbar extension 102-B. If the step 1012 for determining if the occupant 102 is at either full lumbar flexion 102-A or at full lumbar extension 102-B determines that the occupant 102 is at one of those two positions, the next step 1014 is to determine if the occupant 102 is to continue exercising and if the repetition number is to be incremented. If so, the routine loops back to step 1008 of detecting the position of the occupant 102 in the exercise device 100-ED. If not, then the next step 1016 is to stop.

If the step 1012 for determining if the occupant 102 is at either full lumbar flexion 102-A or at full lumbar extension 102-B determines that the occupant 102 is not, then the next step 1018 is to determine if the occupant 102 is on track. That is, is the occupant 102 moving at the correct speed.

If the occupant 102 is on-track, the routine loops back to step 1008 of detecting the position of the occupant 102 in the exercise device 100-ED. If not, then the next step 1020 is to display a warning and provide feedback to the occupant 102. In one embodiment, the feedback is provided by showing a shadow person 908 separate from the idealized FIG. 906 on the screen 902. In another embodiment, audible indication is provided to the occupant 102. The routine then loops back to step 1008 of detecting the position of the occupant 102 in the exercise device 100-ED.

In one embodiment, each of the functions identified in FIG. 10 are performed by one or more software routines executed by the computer 808. In another embodiment, one or more of the functions identified are performed by hardware and the remainder of the functions are performed by one or more software routines run by the computer 808.

The computer 808 executes software, or routines, for performing various functions. These routines can be discrete units of code or interrelated among themselves. Those skilled in the art will recognize that the various functions can be implemented as individual routines, or code snippets, or in various groupings without departing from the spirit and scope of the present invention. As used herein, software and routines are synonymous. However, in general, a routine refers to code that performs a specified function, whereas software is a more general term that may include code that performs more than one routine or more than one function.

In general, the computer 806 executes code that performs a loop. The loop reads the variables provided by the chair monitor 700, displays them as appropriate on the screen 902, determines if the exercise is done and, if not done, repeats the loop. The occupant 102 is done with the exercise when the elapsed time exceeds a selected value or when a specified number of repetitions are completed.

The apparatus includes various functions. The function of providing variable resistance corresponding to the strength curve of the lumbar extensors is implemented, in one embodiment, by the resistance mechanism 500, which includes the four-bar linkage mechanism 430 and the coil assembly 600. The configuration of the four-bar linkage mechanism 430 is such that the exercise device 100-ED has approximately a 1.4 to 1 linear and descending resistance curve through 72 degrees of range of motion 202 of the lumbar extensors of the occupant 102.

The function of providing feedback to the occupant 102 is implemented, in one embodiment, by the remote feedback system 800 displaying data on a screen 902. The data includes degrees of flexion with information on progress and rate of performance of the exercise.

From the foregoing description, it will be recognized by those skilled in the art that a multipurpose chair 100 has been provided. The chair 100 has a task chair configuration 100-TC and an exercise device configuration 100-ED. The chair 100 has a chair monitor 700 that communicates with a remote feedback system 800. The remote feedback system 800 provides real-time visual and audible feedback to the chair occupant 102 during performance of the exercise. The visual feedback includes, in various embodiments, a graphical representation of the chair position relative to an ideal position during execution of the exercise, the angular position of the seatback 106, a counter showing the current repetition number, a timer showing elapsed time, and a display of the amount of force applied at the seatback 106.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. An apparatus that combines a task chair with an exercise device for the lumbar extensors of an occupant of the apparatus, said apparatus comprising:

a seat for supporting the occupant;

a pair of arm rests each adjustable to engage a forearm of the occupant when said apparatus is in a chair configuration, each of said pair of arm rests adjustable to restrain an anterior portion of the pelvis of the occupant when said apparatus is in an exercise device configuration;

a lumbar support positioned to restrain a posterior pelvic region of the occupant when said apparatus is in said exercise device configuration;

a seatback having a substantially upright position when said apparatus is in a chair configuration, said seatback movable between a first position and a second position with said apparatus in said exercise device configuration, said first position corresponding to a lumbar extension position, said second position corresponding to a lumbar flexion position; and a resistance mechanism connecting said seatback to said seat, said resistance mechanism applying a seatback force to said seatback that substantially corresponds with a strength curve of the lumbar extensors of the occupant across a range of motion of said seatback, and said resistance mechanism including a plurality of springs biasing a first member of a linkage mechanism, said linkage mechanism converting a spring force applied by said plurality of springs to said seatback force wherein said seatback force applied to said seatback has a descending resistance curve, said linkage mechanism includes a stationary member, said first member, a second member, and a third member, said first and second members pivotably connected to opposite ends of said stationary member, said third member having a first distal end pivotably attached to said first member at an end of said first member opposite said stationary member, said third member having a second distal end pivotably attached to said second member at an end of said second member opposite said stationary member, said second member attached to said seatback with said seatback moving in tandem with said second member.

2. The apparatus of claim 1 wherein said seatback force varies with a ratio of at least 1.4 to 1 between said second position and said first position wherein said seatback force is greater with said seatback in said second position that corresponds to said lumbar flexion position.

3. The apparatus of claim 1 wherein said resistance mechanism includes a plurality of engaging mechanisms, and each one of said plurality of engaging mechanisms selectively enabling a corresponding one of said plurality of springs to bias said seatback.

4. The apparatus of claim 3 further including a detector for each one of said plurality of springs, each detector providing an output corresponding to an engagement status of a corresponding one of said plurality of springs.

5. The apparatus of claim 1 further including a chair monitor that includes a detector responsive to said seatback force applied to said seatback, a position sensor responsive to an angular position of said seatback, a controller, and a transmitter; said detector and said position sensor communicating with said controller; said controller generating a signal corresponding to said seatback force and said angular position; and said signal being transmitted by said transmitter.

6. The apparatus of claim 1 further including a chair monitor and a remote receiver, said chair monitor transmitting a signal corresponding to said seatback force applied to said seatback and an angular position of said seatback, said remote receiver including a receiver and a controller, and said receiver responsive to said signal and said controller configured to communicate said signal to a computer.

7. The apparatus of claim 1 wherein each one of said plurality of springs is a coil spring.

8. An apparatus that combines a task chair with an exercise device for the lumbar extensors of an occupant of the apparatus, said apparatus comprising:

a seat for supporting the occupant;

a seatback having a substantially upright position when said apparatus is in a chair configuration, said seatback movable between a first position and a second position with said apparatus in an exercise device configuration, said first position corresponding to a lumbar flexion position, said second position corresponding to a lumbar extension position; and a resistance mechanism including a spring assembly and a linkage mechanism, said resistance mechanism applying a seatback force between said seatback and said seat wherein said seatback force decreases as the angle between said seatback and said seat increases wherein said linkage mechanism converts a spring force to said seatback force by decreasing said spring force, said spring assembly biases a first member of said linkage mechanism, said linkage mechanism includes a stationary member, said first member, a second member, and a third member, said first and second members pivotably connected to opposite ends of said stationary member, said third member having a first distal end pivotably attached to said first member at an end of said first member opposite said stationary member, said third member having a second distal end pivotably attached to said second member at an end of said second member opposite said stationary member, said second member attached to said seatback with said seatback moving in tandem with said second member.

9. The apparatus of claim 8 wherein said seatback force substantially corresponds to the strength curve of the lumbar extensors of a human across a range of motion corresponding to movement of said seatback between said first position and said second position.

10. The apparatus of claim 8 further including a pair of arm rests each adjustable to engage a forearm of the occupant when said apparatus is in said chair configuration, each of said pair of arm rests adjustable to restrain an anterior pelvis portion of the occupant when said apparatus is in said exercise device configuration, and further including a lumbar support positioned to restrain a posterior pelvic region of the occupant when said apparatus is in said exercise device configuration.

11. The apparatus of claim 8 wherein said spring assembly includes a plurality of coil springs.

12. The apparatus of claim 8 further including a sensor responsive to an angular position of said seatback relative to said seat; and a transmitter receiving a first input from said sensor.

13. The apparatus of claim 12 further including a receiver responsive to said transmitter, said receiver configured to provide data to a computer having a processing component executing a process including reading said angular position of said seatback, displaying information of said angular position of said seatback, and tracking progress of an exercise routine.

14. The apparatus of claim 13 further including a detector responsive to said seatback force applied to said seatback, said transmitter receiving a second input corresponding to said seatback force detected by said detector, and said process further including reading said seatback force and displaying information of said force.

15. An apparatus that combines a task chair with an exercise device for the lumbar extensors of an occupant of the apparatus, said apparatus comprising:

a seat for supporting the buttocks of the occupant;

a seatback having a substantially upright position when said apparatus is in a chair configuration, said seatback movable between a first position and a second position when said apparatus is in an exercise device configuration, said first and second positions defining a range of motion from lumbar extension to lumbar flexion; and a resistance mechanism including a spring assembly and a linkage mechanism, said linkage mechanism connecting said seatback to said spring assembly, said linkage mechanism converting a spring force to a seatback force, said seatback force applied to said seatback, and said seatback force decreasing as the angle between said seatback and said seat increases, said linkage mechanism includes a stationary member, said first member, a second member, and a third member, said first and second members pivotably connected to opposite ends of said stationary member, said third member having a first distal end pivotably attached to said first member at an end of said first member opposite said stationary member, said third member having a second distal end pivotably attached to said second member at an end of said second member opposite said stationary member, said second member attached to said seatback with said seatback moving in tandem with said second member.

16. The apparatus of claim 15 further including a pair of arm rests each adjustable to restrain an anterior pelvis portion of the occupant when said apparatus is in said exercise device configuration, and further including a lumbar support to restrain a posterior pelvic region of the occupant when said apparatus is in said exercise device configuration.

17. The apparatus of claim 15 wherein said resistance mechanism applies said seatback force to said seatback that substantially corresponds with a strength curve of the lumbar extensors of the occupant across said range of motion of said seatback.

18. The apparatus of claim 15 further including a sensor responsive to an angular position of said seatback relative to said seat;

a detector responsive to a resistance to movement of said seatback relative to said seat when said apparatus is in said exercise device configuration;

a device responsive to said sensor and said detector, said device configured to provide data to a computer; and a program storage device readable by said computer, said program storage device tangibly embodying a program of instructions executable by said computer to perform method steps for a feedback system, said method including the steps of reading said angular position of said seatback and displaying information of said angular position of said seatback, tracking progress of an exercise routine, and reading said resistance to movement of said seatback and displaying information of said resistance to movement.

19. The apparatus of claim 18 wherein said program of instructions further includes steps of comparing a speed of movement to a preselected speed and displaying a result of said comparing step.

20. The apparatus of claim 15 wherein said spring assembly includes a plurality of coil springs.

* * * * *